US009574379B2

(12) United States Patent
Barmscheidt

(10) Patent No.: US 9,574,379 B2
(45) Date of Patent: Feb. 21, 2017

(54) MOTOR VEHICLE DOOR LOCK

(75) Inventor: Christian Barmscheidt, Duisburg (DE)

(73) Assignee: Kiekert Aktiengesellschaft, Heilgenhaus (DE)

( * ) Notice: Subject to any disclaimer, the term of this patent is extended or adjusted under 35 U.S.C. 154(b) by 579 days.

(21) Appl. No.: 14/112,805

(22) PCT Filed: Mar. 28, 2012

(86) PCT No.: PCT/DE2012/000349

§ 371 (c)(1),
(2), (4) Date: Apr. 2, 2014

(87) PCT Pub. No.: WO2012/146223

PCT Pub. Date: Nov. 1, 2012

(65) Prior Publication Data

US 2014/0203572 A1 Jul. 24, 2014

(30) Foreign Application Priority Data

Apr. 23, 2011 (DE) ..... 10 2011 018 512

(51) Int. Cl.

| | |
|---|---|
| ***E05C 3/06*** | (2006.01) |
| ***E05B 77/44*** | (2014.01) |
| ***E05B 81/00*** | (2014.01) |
| ***E05B 81/04*** | (2014.01) |
| ***E05B 77/28*** | (2014.01) |
| ***E05B 81/06*** | (2014.01) |
| ***E05B 81/14*** | (2014.01) |

(Continued)

(52) U.S. Cl.

CPC ..... *E05B 77/44* (2013.01); *E05B 47/023* (2013.01); *E05B 77/28* (2013.01); *E05B 81/00* (2013.01); *E05B 81/04* (2013.01); *E05B 81/06* (2013.01); *E05B 81/14* (2013.01); *E05B 81/34* (2013.01); *E05B 2047/0031* (2013.01); *Y10T 292/108* (2015.04)

(58) Field of Classification Search

CPC ..... E05B 81/00; E05B 81/04
USPC ..... 292/201
See application file for complete search history.

(56) References Cited

U.S. PATENT DOCUMENTS 3,386,761 A * 6/1968 Johnstone ..... E05B 77/48 292/201
3,504,511 A * 4/1970 Allen ..... E05B 47/0607 292/201

(Continued)

FOREIGN PATENT DOCUMENTS

DE 10 2004 002 756 A1 8/2005
DE 20 2004 020037 U1 4/2006

(Continued)

*Primary Examiner* — Carlos Lugo
(74) *Attorney, Agent, or Firm* — Renner, Otto, Boisselle & Sklar, LLP

(57) ABSTRACT

A motor vehicle door lock comprising a locking mechanism (1, 2), an actuating lever unit (3, 4, 16), which interacts with the locking mechanism (1, 2), a drive (6, 7, 8, 9) impinging upon the actuating lever unit (3, 4, 16) and an anti-theft protection device (10, 11), wherein a buffer member (12, 13) is assigned to the actuating lever unit (3, 4, 16) and to an unlocking lever (5) which interacts with the actuating lever unit (3, 4, 16), the buffer member being controlled by the anti-theft protection device (10, 11) in accordance with the desired functional position of the locking mechanism (1, 2).

14 Claims, 4 Drawing Sheets

(51) Int. Cl.

| | |
|---|---|
| ***E05B 47/02*** | (2006.01) |
| ***E05B 81/34*** | (2014.01) |
| *E05C 3/00* | (2006.01) |
| *E05B 47/00* | (2006.01) |

(56) References Cited

U.S. PATENT DOCUMENTS

| | | | | | |
|---|---|---|---|---|---|
| 4,364,249 | A * | 12/1982 | Kleefeldt | E05B 77/48 | 292/144 |
| 4,518,180 | A * | 5/1985 | Kleefeldt | E05B 81/06 | 292/201 |
| 5,802,894 | A * | 9/1998 | Jahrsetz | E05B 77/48 | 292/144 |
| 5,938,252 | A * | 8/1999 | Uemura | E05B 81/14 | 292/201 |
| 5,992,194 | A * | 11/1999 | Baukholt | E05B 47/0009 | 292/201 |
| 6,079,237 | A * | 6/2000 | Hochart | E05B 81/14 | 292/201 |
| 6,386,599 | B1 * | 5/2002 | Chevalier | E05B 81/14 | 292/201 |
| 6,575,507 | B2 * | 6/2003 | Reddmann | E05B 81/14 | 292/201 |
| 7,111,877 | B2 * | 9/2006 | Larsen | E05B 81/14 | 292/201 |
| 8,474,888 | B2 * | 7/2013 | Tomaszewski | E05B 77/26 | 292/201 |
| 8,727,398 | B2 * | 5/2014 | Brose | E05B 15/04 | 292/195 |
| 9,074,393 | B2 * | 7/2015 | Brose | E05B 81/06 | |
| 2002/0060459 | A1 * | 5/2002 | Zintler | E05B 81/90 | 292/216 |
| 2011/0084505 | A1 | 4/2011 | Brose et al. | | |
| 2012/0068480 | A1 * | 3/2012 | Bendel | E05B 85/26 | 292/220 |

FOREIGN PATENT DOCUMENTS

| | | | |
|---|---|---|---|
| DE | 10 2004 052 599 | A1 | 5/2006 |
| DE | 20 2008 015 789 | U1 | 5/2010 |
| EP | 1 149 967 | A2 | 10/2001 |
| EP | 1 884 610 | A2 | 2/2008 |
| EP | 1 956 168 | A2 | 8/2008 |

* cited by examiner

MOTOR VEHICLE DOOR LOCK

CROSS REFERENCE TO RELATED APPLICATIONS

This application claims priority under 35 U.S.C. 119 and 35 U.S.C. 365 based upon German Patent Application No. 10 2011 018 512.7, filed on Apr. 23, 2011. The entire disclosure of the aforesaid application is incorporated herein by reference.

FIELD OF THE INVENTION

The invention relates to a motor vehicle door lock equipped with a locking mechanism, an actuating lever unit which interacts with the locking mechanism also a drive impinging on the actuating lever unit and an anti-theft protection device.

BACKGROUND OF THE INVENTION

Such motor vehicle door locks are known from practical application and are, for instance, described in DE 10 2004 002 756 A1. As usual, the anti-theft protection device serves to deactivate the actuating lever mechanically connected to the locking mechanism during an impingement of the actuating lever unit by an internal release lever and during activation by an external release lever. This ensures that even if, for instance, the window has been smashed, unauthorized persons could not open the motor vehicle door using the internal release lever. This applies if the anti-theft protection device is active. The device is then in the position "Anti-theft protection on".

If the motor vehicle door lock is, however, in the position "Anti-theft protection off", the respective motor vehicle door can be opened from inside using the internal release lever and from the outside using the external release lever. This assumes that the door is not a rear side door in which a potential childlock is and can be engaged. This has generally proven to be successful.

Apart from motor vehicle door locks containing such an anti-theft protection device there are also door locks also containing a closing/opening device. In this context reference is made to utility model DE 20 2008 015 789 U1. In addition, prior art embodiments disclose, for instance, opening devices in DE 10 2004 052 599 A1 operating as opening aids. Such opening devices or opening aids use in the simplest form an electric drive, lifting a pawl off a rotary latch of a closed locking mechanism. As a result, the rotary latch can open with the aid of a spring and can release a previously retained locking bolt and thus the respective motor vehicle door as such.

Prior art is, however, not satisfactory in all aspects. This applies in particular with regards to the already described opening aids or the so-called "electric opening". In the best possible design this process involves the locking mechanism being disengaged by an electric motor to release an associated motor vehicle door. In the event of this process being unintentionally initiated by, for instance, a fault current, a fault signal, etc., no convincing solutions preventing this have been available so far. This situation is remedied by the invention.

SUMMARY OF THE INVENTION

The invention is based on the technical problem of further developing a motor vehicle door lock in such a way that operating reliability is significantly improved, in particular during electric opening and the malfunctioning is avoided.

To solve this technical problem the invention provides a generic motor vehicle door lock with a buffer member assigned to the actuating lever unit and to an unlocking lever, which is controlled by the anti-theft protection device in accordance with a desired functional position of the locking mechanism.

As part of the invention the buffer member ensures in connection with the anti-theft protection device that a, so to speak, additional securing of the locking mechanisms is implemented. Indeed the anti-theft protection device ensures that an electric opening process of the locking mechanism is only carried out when the anti-theft protection device releases the buffer member for the associated pivoting of the locking mechanism. If, on the other hand, the buffer member is blocked, the locking mechanism can also not move into the opened functional position. Consequently unintentional opening of the locking mechanisms is ruled out, as in this case the anti-theft protection device blocks the buffer member and the locking mechanism cannot be opened as a result.

In fact the buffer member is, as it were, interposed between the drive impinged on by the actuation lever unit and the locking mechanism. The drive thus acts on the buffer member, which in turn transfers the movement of the actuating lever unit initiated by the drive onto the locking mechanism. During this process an opening movement of the drive is for instance only translated into an opening movement of the locking mechanism via the actuating lever unit and the buffer member and then onto the locking mechanism, if the buffer member is, for instance, not blocked by the anti-theft protection device. As when the buffer member is blocked, the locking mechanism is not influenced by the impinged on actuating lever unit and stays thus in its closed position in the described example.

Only when, whilst the actuating lever unit is acted upon by the drive, the anti-theft protection device also releases the buffer member is the actuating lever able to transfer a movement to the locking mechanism via the buffer member. In other words this prevents, as part of the invention, any and unintentional opening operations with the aid of the anti-theft protection device. Only when the drive impinging on the actuating lever unit and at the same time the anti-theft protection device operate in such a way that the actuating lever unit can disengage the locking mechanism via the buffer member, does the desired opening process occur. This all is achieved with strikingly simple means and with a simple design, so that not only the described functional but also cost advantages are achieved.

The design is in any case such that the buffer member is controlled by the anti-theft protection device. If the locking mechanism is to retain its closed position, the buffer member is blocked by the anti-theft protection device and cannot act on the locking mechanism if the actuation lever unit is impinged upon in the opening sense. If, on the other hand, the locking mechanism is to be opened, the anti-theft protection device releases the buffer member. Said member can after an opening movement of the actuation lever unit open the locking mechanism. In other words, the buffer member is respectively triggered by the anti-theft protection device in accordance with the desired functional position of the locking mechanism ("open" or "closed").

Apart from this, the anti-theft protection device naturally provides the functions already explained above. This means that any impinging of the actuating lever unit has no effect on the locking mechanism as long as the anti-theft protection device is in its "engaged" position. This means that in this functional position the anti-theft protection device continuously ensures that any movements of the actuating lever unit are not transferred onto the locking mechanism via the buffer member. Instead, the buffer member is subjected to a more or less pronounced compression or deflection during such a procedure and in such a way that the locking mechanism is not affected in any way by this.

Only when the anti-theft protection device is moved into its "disengaged" position can the actuating lever unit impinge on the locking mechanism in the opening sense. This is because in this case opening movements of the actuating lever unit are, for example, transferred again onto the buffer member, which due to the removal of the blocking transfers these movements onto the locking mechanism via the anti-theft protection device, opening said mechanism. In this arrangement the design will always be such that in the position "anti-theft protection engaged" a respective internal release lever as well as an external release lever will have no affect on the locking mechanism.

As part of the invention, an unlocking lever is assigned to the actuating lever unit. In most cases, also the said buffer member is assigned to the unlocking lever. At the same time a two-part design of the buffer member has proven to be particular advantageous. In fact the buffer member generally consists of a rocker spring and a leg spring.

The rocker spring generally ensures that the actuating lever unit is, depending on its position, acted upon in the direction "open" or in the direction "keep closed" of the locking mechanism. For this purpose, the rocker spring engages in most cases with the unlocking lever. If the unlocking lever has exceeded a certain position compared to the locking mechanism, the rocker spring can act on the unlocking lever in the "open" direction of the locking mechanism. If, on the other hand, the unlocking lever is in a different position, the rocker spring ensures that the unlocking lever and thus the actuating lever unit is acted upon in the "keep closed" position of the locking mechanism.

In addition to the rocker spring the arrangement is known to also contain a leg spring. This leg spring can, on one hand, interact with a coupling lever and, on the other hand, with the unlocking lever and/or the anti-theft protection device. At the same time, the one free leg of the leg spring rests in most cases against the coupling lever. This free leg is then, depending on the position of the coupling lever and/or of an internal release lever interacting with the coupling lever, acted upon and can also follow this movement. In contrast, the other fixed leg of the leg spring rests against a journal of the unlocking lever. In addition, the anti-theft protection device interacts with the respective fixed leg of the leg spring.

For this purpose the leg spring is advantageously mounted on the unlocking lever. Mounting of the leg spring on an axis that essentially corresponds to the axis of rotation of the unlocking lever has shown to be particular advantageous. This means that the axis of the leg spring and the axis of rotation of the unlocking lever generally correspond or lie inside each other.

The aforementioned coupling lever, generally resting against the free leg of the leg spring is typically mounted in at least one guide. In most cases two guides are used for the coupling lever. The two guides are generally provided in adjacent levers. It has proven to be advantageous for one of the guides to be provided in an internal release lever and the other guide in the unlocking lever. This allows the coupling lever to freely glide along its "ineffective" and "effective positions" on the free leg of the leg spring.

If the coupling lever is in its "ineffective" position this corresponds to the "locked" position of the motor vehicle door lock. The locking mechanism can only be opened by the internal release lever and not by the external release lever if the anti-theft protection device is also in its "off" position. If the coupling lever is, however, in its "effective" position, the motor vehicle door lock as a whole is in its "unlocked" position. In this case, too, any movements of the actuating lever unit are only transferred to the locking mechanism in the opening sense, if the anti-theft protection device is in its "disengaged" position. Otherwise any actuation of the actuating lever unit causes the actuating lever unit to act on the buffer member in a deforming manner without the locking mechanism being opened. In this "unlocked" functional position the anti-theft protection device can generally also be mechanically disengaged by the actuating lever unit being actuated in the opening sense.

As a result, the invention provides a motor vehicle door lock that, in particular as regards the "electric opening" function, provides a significant additional level of safety. Even unintentional electric opening processes are not translated into an opening of the locking mechanism as long as the anti-theft protection device is in its "engaged" functional position. Only when the anti-theft protection device also assumes its "disengaged" position can the desired electric opening be translated into the opening of the locking mechanism.

BRIEF DESCRIPTION OF THE DRAWINGS

Below, the invention is explained in more detail with reference to exemplary drawings showing only one embodiment, as follows.

Other features and advantages of the present invention will become apparent from the following detailed description, taken in conjunction with the accompanying drawings which illustrate, by way of example, the principles of the invention.

DETAILED DESCRIPTION OF THE INVENTION

Figure 1:
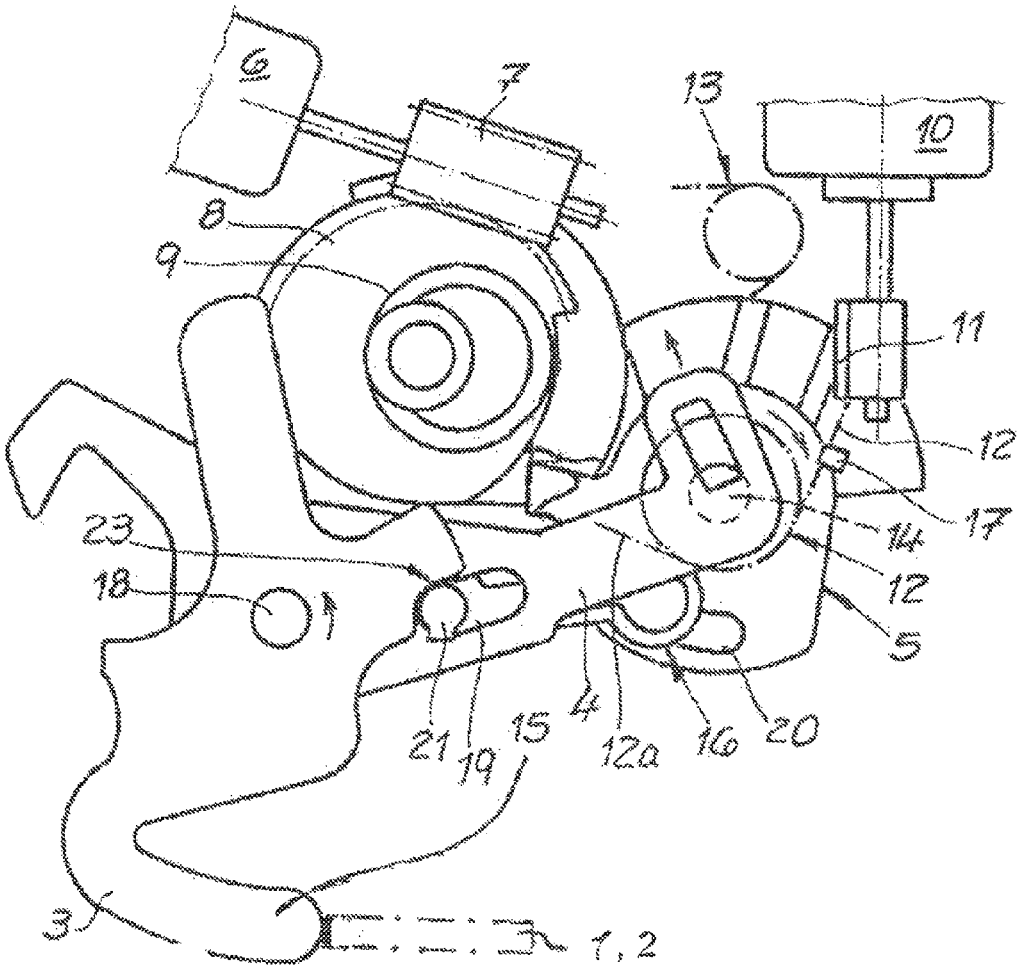
FIG. 1 shows an overview of the motor vehicle door lock of the invention in the "unlocked" position and with the anti-theft detection device being "disengaged"

FIG. 1 shows a motor vehicle door lock equipped with a locking mechanism 1, 2, only indicated in the figure. Indeed all figures do show a pawl 1, interacting with a rotary latch 2 in the usual manner but which is not expressly shown. This is because the pawl 1 and the rotary latch 2 are located together in a plane vertical to the shown planes of projection. An actuating lever unit 3, 4, 16, comprising in detail a release lever 3, an internal release lever 4 and a coupling lever 16, interacts with the locking mechanism 1, 2 and said unit then interacts with an unlocking lever 5 in the example. The arrangement can in principle contain even more levers, such as an external release lever, another coupling lever, etc., which are however not shown and are of no significance for the described invention. The figure also shows a drive 6 to 9, impinging on the actuation lever unit 3, 4, 16. Finally, the general arrangement contains an anti-theft protection device 10, 11.

As part of the invention, a buffer member 12, 13 is assigned to the actuating lever unit 3, 4, 16 and to the unlocking lever 5. This buffer member 12, 13 is actuated by the anti-theft protection device 10, 11. This depends on the desired functional position of the locking mechanism 1, 2. In other words, the anti-theft protection device 10, 11 either releases or blocks the buffer member 12, 13. In the embodiment the buffer member 12, 13 comprises a leg spring 12 and a rocker spring 13 and is thus made up of two parts. Depending on the position of the unlocking lever 5 and of the actuating lever unit 3, 4, 16 as a whole, the rocker spring 13 ensures that the unlocking lever 5 is acted upon in the "open" or "keep closed" direction of the locking mechanisms 1, 2.

Figure 2:
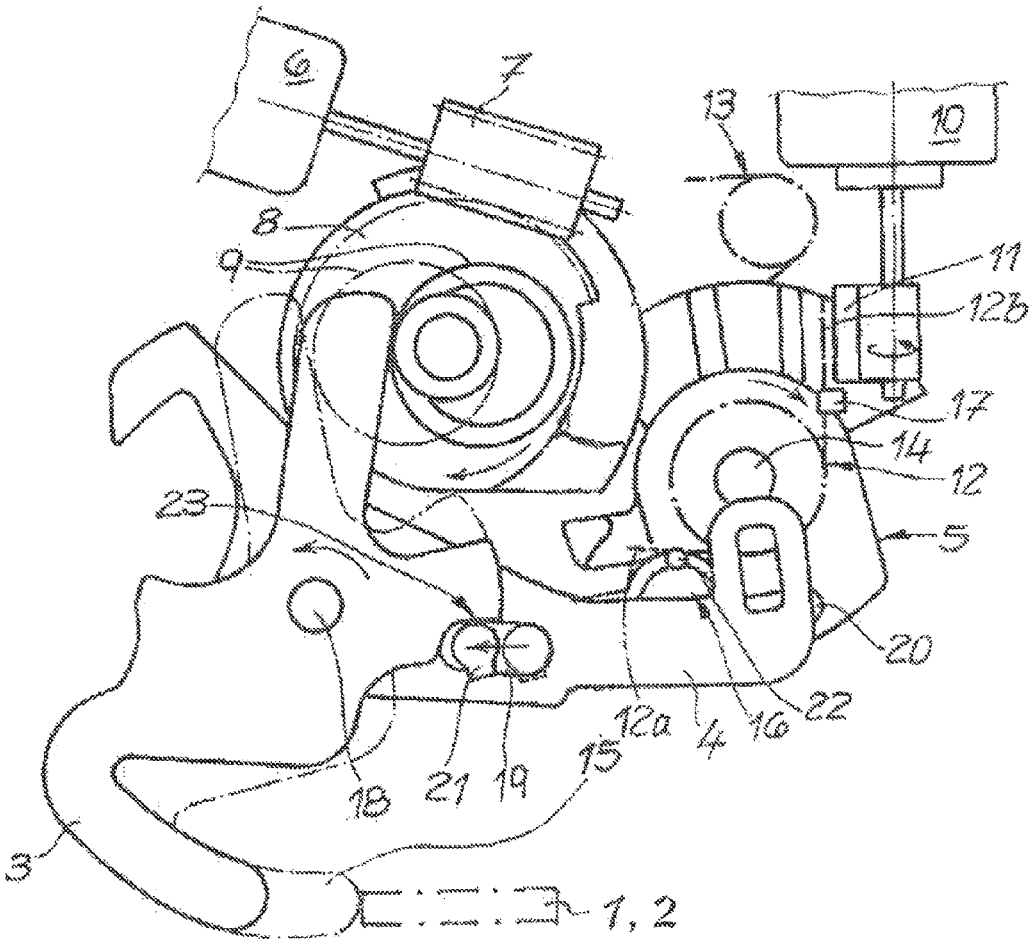
FIG. 2 shows the motor vehicle door lock of FIG. 1 during electric opening.
Figure 3:
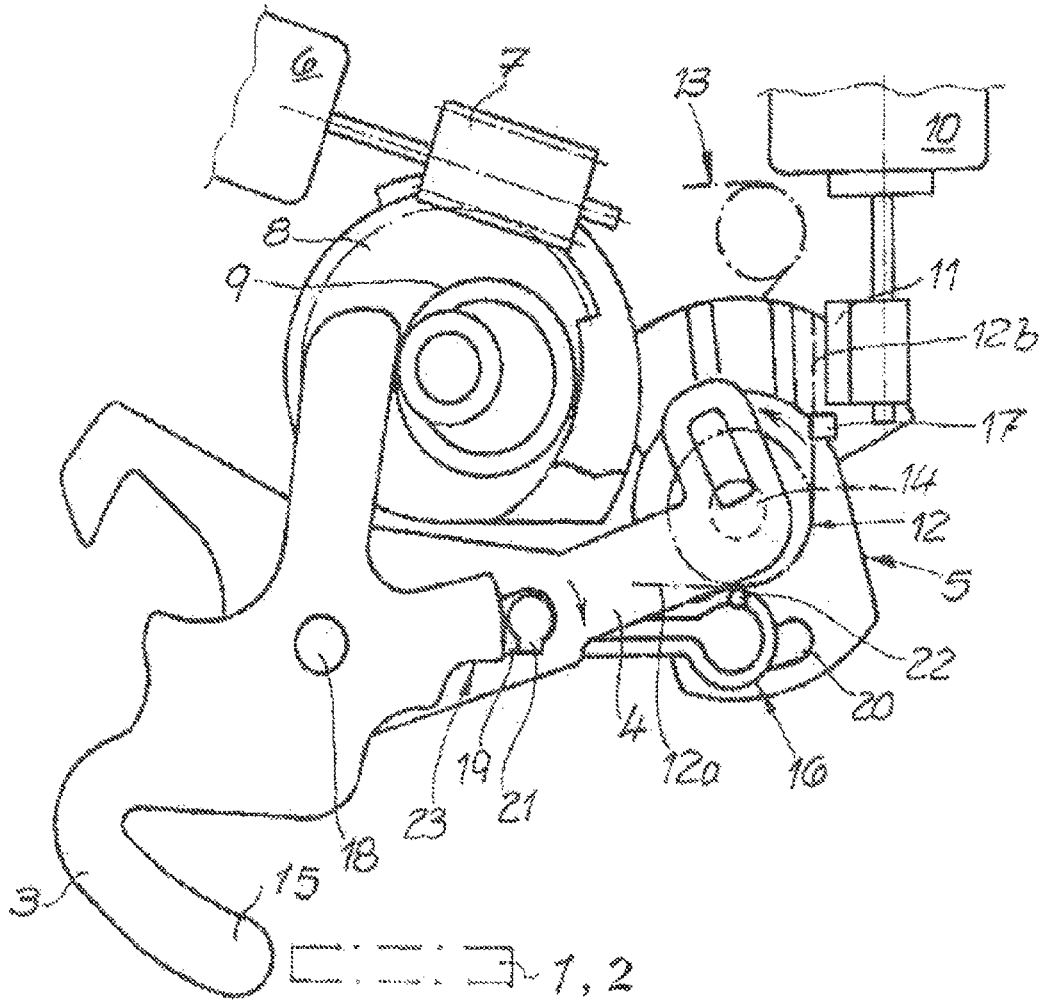
FIG. 3 shows the motor vehicle door lock of FIGS. 1 and 2 in the locked state with engaged anti-theft protection device.

If the unlocking lever 5 is, for instance in the "locked" position of the motor vehicle door lock shown in FIG. 3, rocker spring 13 acts upon the unlocking lever 5 in such a way that this is impinged on in counter-clockwise direction around its axis 14 as indicated. If, on the other hand, the rocker spring 13 or the associated unlocking lever 5 assumes the "unlocked" position of FIG. 2, the rocker spring 13 acts upon the unlocking lever 5 in such a way that it rotates in the shown clockwise direction around its axis 14. As a result, the release lever 3 can, when in the functional position shown in FIG. 2, impinge with its extension arm 15 on the pawl 1 during the shown "electric opening" and can lift the pawl 1 during this process from the associated rotary latch 2—not shown. The locking mechanism 1, 2 is consequently also opened at the end of the "electric opening" movement shown in FIG. 2.

In contrast, the leg spring 12 interacts, on one hand, with a coupling lever 16 and, on the other hand, with the unlocking lever 5 and/or the anti-theft protection device 10, 11. For this purpose the one free leg 12*a* of the leg spring 12 rests against the coupling lever 16, which can mainly slide linearly along the said free leg 12*a* of the leg spring 12. In contrast, the other fixed leg 12*b* of the leg spring 12 is supported on a stop 17 of the unlocking lever 5. In addition, the anti-theft protection device 10, 11 with its cam 11 is assigned to the fixed leg 12*b* of the leg spring 12. Depending on the position of the anti-theft protection device 10, 11, the cam 11 blocks the fixed leg 12*b* of the leg spring 12 and retains the leg spring 12 at the same time. This applies for the position "anti-theft protection device inserted". If, however, the anti-theft protection device 10, 11 is in its "disengaged" position, the cam 11 releases said fixed leg 12*b* of the leg spring 12.

Die leg spring 12 is mounted on the unlocking lever 5 on an essentially common axis. This means that the axis of rotation of the leg spring 12 mainly corresponds with the axis of rotation 14 of the unlocking lever 5. Also the arrangement is in most cases such that the aforementioned drive 6 to 9 is designed as an opening drive. For this purpose the drive 6 to 9 consists of an electric motor 6 and a worm gear 7 driven by the electric motor 6. The worm gear 7 engages with a driving pulley 8, accommodating a cam 9 on the external circumference. In this way, the drive 6 to 9 can interact with the release lever 3.

If the release lever 3 is in the position shown in FIG. 3, the drive or the opening drive 6 to 9 ensures, as part of the opening process shown in FIG. 2, first of all that the release lever 3 is moved from its initial position shown by the solid line to the position shown by the dashed/dotted line (see FIG. 2). This is achieved with the cam 9, coming into contact with the release lever 3 and pivoting the release lever 3 during this process around its axis 18 in clockwise direction.

As a result of this operation, the previously blocked coupling lever 16 is released. Said coupling lever 16 is in fact arranged in two guides 19, 20 with one guide 19 for the coupling lever 16 being arranged on the internal release lever 4 and the other guide 20 in the unlocking lever 5. A cam 21 of the coupling lever 16 engages in the guide 19 of the internal release lever 4 and is thus captively retained in the respective guide 19 of the internal release lever 4 and also in guide 20 of the unlocking lever 5 and is linearly guided.

It is apparent that the coupling lever 16 also contains a journal 22, sliding along the free leg 12*a* of the leg spring 12. If the coupling lever 16 moves from its right and "ineffective" position ("locked") as shown in FIG. 2 into the left and "effective" position (unlocked), said journal 22 slides at the free end of 12*a* of the leg spring 12 into a radial outer position. As a result, the leg spring 12 is increasingly acted upon. Also, the coupling lever 16 and its cam 21 is released from the release lever 3 and thus enters a recess 23 in the release lever 3.

The function is as follows. FIG. 1 shows the position (mechanically) "unlocked", followed by mechanical opening with the anti-theft protection device 10, 11 "disengaged". It is apparent that first of all the release lever 3 has carried out a counter-clockwise movement around is axis 18 starting from the locked position shown in FIG. 3. This transition of the release lever 3 from the "locked" position of FIG. 3 to the "unlocked" position of FIG. 1 can be mechanically initiated by the internal release lever 4 being slightly pivoted around its axis 18 in clockwise direction as shown by an error in FIG. 3. The internal release lever 4 and the release lever 3 do in fact share a common axis 18 around which they can be pivoted.

This operation causes the cam 21 of the coupling lever 16 to enter the recess 23 of the release lever 3. This operation is assisted by the fact that the rocker spring 13 acts upon the unlocking lever 5 in clockwise direction as apparent from FIG. 2. After this mechanical unlocking process the internal release lever 4 with the coupling lever 16 or the cam 21 on the coupling lever 16 rests in any case against the release lever 3 in the respective recess 23. As soon as, starting from this functional position shown in FIG. 1, the internal release lever 4 is pivoted around its axis 18 in counter-clockwise direction, as indicated in FIG. 1, the carried-along coupling lever 16 ensures with the journal 22 abutting the free leg 12*a* that the leg spring 12 is acted upon.

As the leg spring 12 with its fixed end 12*b* is not blocked by the anti-theft protection device 10, 11 or its cam 11, as the anti-theft protection device 10, 11 is in the "disengaged" state, the leg spring 12 "carries along" the unlocking lever 5 during this process. This is achieved by the fixed leg 12*b* of the leg spring 12 engaging with the stop 17 of the unlocking lever 5. The unlocking lever 5 thus carries out a pivoting movement in clockwise direction around it axis 14, as already indicated in FIG. 2 and also in FIG. 1. As a result, the unlocking lever 5 ensures that the pawl 1 can be lifted off the rotary latch 2 by the actuating lever unit 3, 4, 16. The locking mechanism 1, 2 has been mechanically opened.

A similar scenario is shown in FIG. 2. The figure depicts the "electric opening" operation. During such electric opening the release lever 3 must first of all be moved into its "unlocked" position by the drive or opening drive 6, 7, 8, 9, as shown by the dashed/dotted line in FIG. 2. The position "locked" of the release lever 3 is in contrast shown by a solid line. In order to achieve this change of position, the cam 9 of the drive 6, 7, 8, 9 comes into contact with an arm of the release lever 3 and ensures that during the transition from the "locked" position shown by the solid line to the position shown by the dashed/dotted line, the release lever 3 carries out a small counter-clockwise movement around its axis 18, as indicated by the direction of the arrow, and disengages the pawl 1.

As a result, the cam 21 on the coupling lever 16 can enter the recess 23 of the release lever 3. As a result of this process, the leg spring 12 is increasingly acted upon at its free leg end 12*a* as the coupling lever 16 is at the same time moved radially outwards and the journal 22 resting against the coupling lever 16 acts upon the free leg end 12 of the leg spring 12 with increasing force. If during this process anti-theft protection device 10, 11 is also disengaged (see arrow in FIG. 2), the unlocking lever 5 is rotated in clockwise direction around its axis 14, as indicated, as the leg spring 12 is being acted upon at its free leg end 12*a*. This is either caused by the journal 22 or also by the internal release lever 4 being pivoted around its axis 18 in clockwise direction as shown in FIG. 1. In any case the fact that the leg spring 12 is being acted upon at its free leg end 12*a* ensures that the fixed leg end 12*b* carries along the unlocking lever around the axis 14 with its stop 17, in the described direction of rotation.

Figure 4:
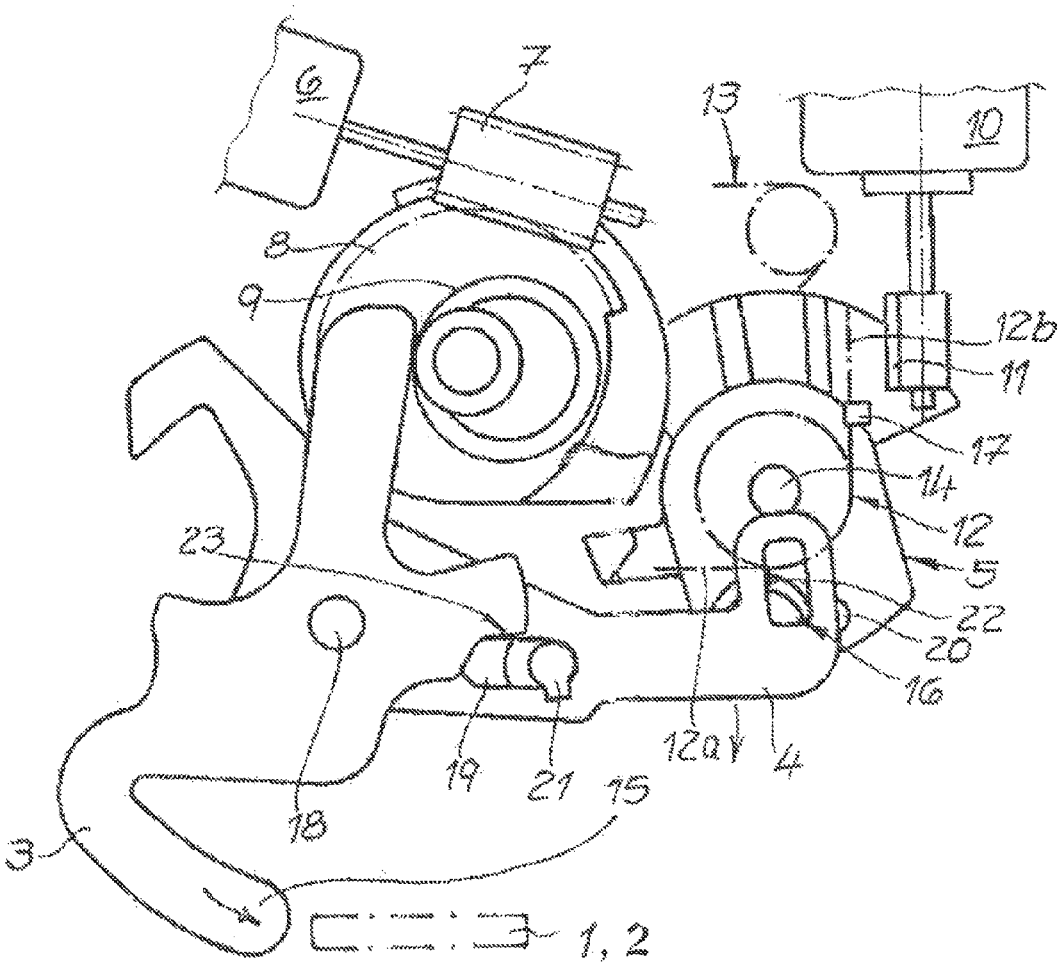
FIG. 4 shows the object of FIGS. 1 to 3 during mechanical opening.

The operation "disengage anti-theft protection device 10, 11" can be carried out electrically or mechanically. In any case the operation corresponds with the cam 11 being pivoted from the initial "engaged" position as shown in FIG. 3 or FIG. 2 in the direction of the arrow and then assumes the "disengaged" position as shown in FIG. 4 or FIG. 1. As a result, the fixed leg end 12*b* of the leg spring 12 is as a whole released from the anti-theft protection device 10, 11 or the cam 11 and the unlocking lever 5 can, as described, pivot around its axis 14 in clockwise direction. As a result, the pawl 1 acted upon by the release lever 3 via the actuating lever unit 3, 4, 16 is again lifted off the associated rotary latch 2.

This means that as part of the electric opening according to FIG. 2, the anti-theft protection device 10, 11 ensures amongst other things and mainly that unintentional opening operations do not cause the locking mechanism to open. This is because the locking mechanism 1, 2 is only and exclusively opened, if the anti-theft protection device 10, 11 has first released the free leg end 12*b* of the leg spring 12 with its cam 11. If the leg end is not released as part of the function depicted in FIG. 2, the leg spring 12 is compressed as a result of the internal release lever 4 impinging on it without the unlocking lever 5 changing the shown position. Only if the fixed leg end 12*b* is not (no longer) blocked by the cam 11 of the anti-theft protection device 10, 11, does the unlocking lever 5 carry out the described clockwise rotation around its axis 14 and is the locking mechanism 1, 2 opened.

In the functional position shown in FIG. 3 the motor vehicle door lock is in the "locked" position as the cam 21 of the coupling lever 16 rests against the release lever 3 and is blocked by the release lever 3. Also, the anti-theft protection device 10, 11 is in its functional position "engaged", so that the leg spring 12 is secured between the blocked coupling lever 16, on one hand and the cam 11 of the anti-theft protection device 10, 11, on the other hand. From this point a release only takes place if the internal release lever 4 is moved slightly around its axis 18 in clockwise direction, as indicated by an arrow in FIG. 3 and as is apparent from the transition between FIG. 3 and FIG. 4. The coupling lever 16 can then be moved with its cam 21 along the guide 19 in the internal release lever 4 and the cam 21 of the coupling lever 16 is able to enter the recess 23 in the release lever 3. A spring impinging on the coupling lever 16 in the respective sense but not expressly shown in the figures, can be responsible for this. The subsequent impinging on of the internal release lever 4 in the opening sense by a counter-clockwise movement around axis 18 then causes, starting from the functional position shown in FIG. 2, the release lever 3 to be carried along and to take up its position shown by the dashed/dotted line.

If the anti-theft protection device 10, 11 is "disengaged" during this process, the process results in the unlocking lever 5 being pivoted around its axis 14 in clockwise direction and the locking mechanism 1, 2 being impinged on by the release lever 3 via the actuating lever unit 3, 4, 16 in the opening sense.

It is to be understood that the above-described embodiment is illustrative of only one of the many possible specific embodiments which can represent applications of the principles of the invention. Numerous and varied other arrangements can be readily devised by those skilled in the art without departing from the spirit and scope of the invention.

What is claimed is:

1. A motor vehicle door lock comprising: a locking mechanism, an actuating lever unit, which interacts with the locking mechanism, a drive impinging upon the actuating lever unit and an anti-theft protection device, wherein a biasing member is assigned to a lever of the actuating lever unit and to an unlocking lever which interacts with the actuating lever unit, and wherein said biasing member is either blocked or unblocked by the anti-theft protection device respectively in an anti-theft position and a non-anti-theft position to allow or prevent unlocking of the locking mechanism.

2. The motor vehicle door lock according to claim 1, wherein the biasing member is arranged between the drive and the locking mechanism.

3. The motor vehicle door lock according to claim 1, wherein the biasing member is made up of two parts, a leg spring and a rocker spring.

4. The motor vehicle door lock according to claim 3, wherein the rocker spring impinges on the unlocking lever depending on its position in an "open" or "keep closed" position of the locking mechanism.

5. The motor vehicle door lock according to claim 3, wherein the leg spring interacts with a coupling lever on one hand and the unlocking lever and/or anti-theft protection device on the other hand.

6. The motor vehicle door lock according to claim 5, wherein a one free leg of the leg spring rests against the coupling lever and an other fixed leg rests against a journal of the unlocking lever.

7. The motor vehicle door lock according to claim 3, wherein the leg spring is mounted on the unlocking lever essentially on the same axis as its axis of rotation.

8. The motor vehicle door lock according to claim 1, wherein the drive is designed as an opening drive and contains a cam driven by an electric motor for opening.

9. The motor vehicle door lock according to claim 1, wherein the drive interacts with a release lever.

10. The motor vehicle door lock according to claim 1, wherein in an "unlocked" position the unlocking lever releases a previously blocked coupling lever.

11. The motor vehicle door lock according to claim 10, wherein the coupling lever is mounted in at least one guide.

12. The motor vehicle door lock according to claim 11, wherein two guides are provided for the coupling lever which are arranged in adjacent levers.

13. The motor vehicle door lock according to claim 12, wherein the one guide is provided in an internal release lever and an other guide in the unlocking lever.

14. The motor vehicle door lock according to claim 3, wherein the anti-theft protection device is equipped with a motor and a cam acted upon by the motor for blocking a fixed leg of the leg spring.

* * * * *